United States Patent [19]

Hardesty

[11] 4,296,689

[45] Oct. 27, 1981

[54] ROTARY LOCKING MECHANISM

[75] Inventor: Thomas K. C. Hardesty, Ednor, Md.

[73] Assignee: The United States of America as represented by the Secretary of the Navy, Washington, D.C.

[21] Appl. No.: 60,557

[22] Filed: Jul. 25, 1979

[51] Int. Cl.[3] ..... F42C 15/20

[52] U.S. Cl. ..... 102/260; 102/254; 285/314; 403/DIG. 8

[58] Field of Search ..... 89/1.5 D; 102/258, 259, 102/253, 254, 239, 244, 226, 261, 274; 285/314, 317, 91; 403/DIG. 8, DIG. 4

[56] References Cited

U.S. PATENT DOCUMENTS

| | | | |
|---|---|---|---|
| 2,006,833 | 7/1935 | Jensen | 285/314 X |
| 2,470,256 | 5/1949 | McIlroy | 285/314 X |
| 2,717,042 | 9/1955 | Grant et al. | 102/274 X |
| 3,083,042 | 3/1963 | Collor | 285/314 X |
| 3,277,785 | 10/1966 | Clayton | 102/274 X |
| 3,480,310 | 11/1969 | McElwain | 285/314 X |
| 3,511,183 | 5/1970 | Geffner | 102/229 |
| 3,754,496 | 8/1973 | Noel | 102/10 X |

*Primary Examiner*—David H. Brown
*Attorney, Agent, or Firm*—R. S. Sciascia; A. L. Branning; W. R. Henderson

[57] ABSTRACT

A mechanism for immobilizing an arming shaft to preclude axial movement of the shaft until its release is desired, comprising a base and rotor mounted thereon. The rotor holds hardened metal balls in engagement with a circumferential groove on the shaft to lock the shaft in position. The base, rotor and shaft are held in locked position by an arming wire. Compression springs acting between the base and rotor cause relative rotation thereof, when the arming wire is removed, to an unlocked position where the balls can be forced into apertures in the base and release the shaft for axial movement.

6 Claims, 8 Drawing Figures

ROTARY LOCKING MECHANISM

BACKGROUND OF THE INVENTION

1. Field of the Invention

This invention relates generally to ball-lock mechanisms, and more particularly to ball-lock mechanisms which are unlocked by rotary as opposed to longitudinal motion.

2. Description of the Prior Art

Military weapons such as bombs, torpedoes, missiles and the like, are customarily provided with a safing-arming mechanism which enables the weapon to be maintained in a safe or unfirable condition during handling, and to enable arming of the weapon when it is ready for use. These safing-arming mechanisms frequently take the form of a shaft or rod which is movable axially from a safe to an armed position. The arming shaft customarily carries either, an element of an explosive train held out of alignment to interrupt the explosive train when the arming shaft is in a safe position, or, a switch contact or contacts which are held out of their arming positions when the arming rod is in the safe position. A mechanism, such as a ball-lock mechanism, is provided to hold the arming shaft in the safe position until it is desired to arm the weapon.

Many prior art devices have used hardened metal balls to provide a variety of ball-lock mechanisms for arming shafts. These prior art devices have all used essentially a longitudinal motion to operate the ball-locking mechanism. This longitudinal motion is often undesirable. For weapons that are launched from aircraft and submarines, the method of keeping an arming device locked at all times can be a problem. In addition to requiring more space, certain prior art longitudinal locks tended to protrude from the surface of the weapon case after actuation which would increase aerodynamic or hydrodynamic drag. Also, the prior art devices tend to reduce visibility of the arming shaft from the outside of the weapon case, thus making visual observation of a safe condition difficult or impossible.

SUMMARY OF THE INVENTION

The present invention obviates the aforementioned difficulties, and also provides means for visual observation of the shaft position to determine whether it is in its locked or unlocked condition. The locking mechanism is easily controlled by means of an arming wire, safety lock, or safety bar usually associated with military weapons. The shaft is held longitudinally secure by hardened steel balls which are held in position by the base member until release by the rotation of the rotor under the influence of two compression springs until reaching the limit stops. The internal diameter of the rotor is in two steps, the smaller holding the four balls in a locked position and the larger diameter aligning the balls to move outward into apertures in the base member to free the grooved arming shaft for longitudinal movement to the arming position.

STATEMENT OF THE OBJECTS OF THE INVENTION

It is a primary object of this invention to provide a ball-lock mechanism which is unlocked by rotary motion of the locking elements.

It is another objective of this invention to provide a rotary locking mechanism for an arming shaft in which a single arming wire locks both the rotary lock and shaft in safe position until the arming wire is removed.

It is a further object of this invention to provide a rotary locking mechanism in which the arming wire is restrained solely by the drag produced by the locked mechanism.

It is yet another object of this invention to provide a rotary locking mechanism for an arming shaft which may readily be visually inspected to determine safe and unsafe conditions.

It is a still further object of this invention to provide a rotary lock for arming shafts which may be maintained in a safe condition by means of arming wires, lanyards, channel-shaped or forked brackets and other similar devices.

BRIEF DESCRIPTION OF THE DRAWINGS

Other objects, advantages and novel features of the invention will become readily apparent from the following detailed description of the invention when considered in conjunction with the accompanying drawings wherein.

DESCRIPTION OF THE PREFERRED EMBODIMENT

Figure 1:
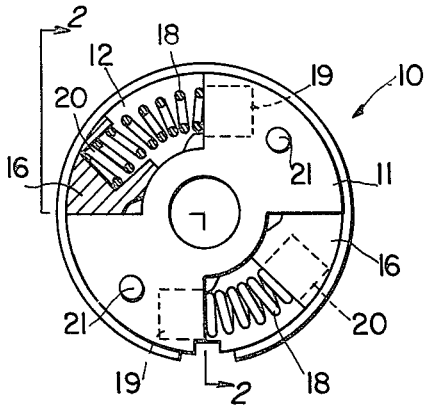
FIG. 1 is a plan view of the rotary locking mechanism of the present invention illustrating the various parts thereof in the unlocked position.
Figure 2:
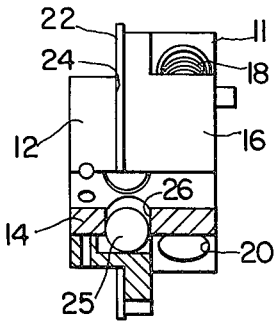
FIG. 2 is a sectional view taken along the line 2—2 of FIG. 1 and illustrates additional details of the ball-lock mechanism.
Figure 3:
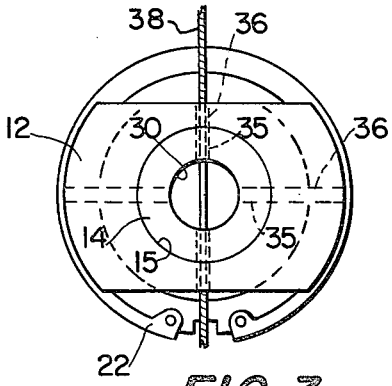
FIG. 3 is a plan view of the side opposite that shown in FIG. 1 and illustrates the positions of the arming wire holes and the retaining ring for mounting the mechanism in a weapon.
Figure 4:
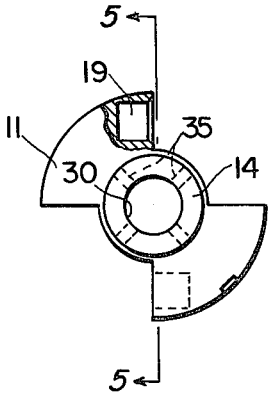
FIG. 4 is a view, partially in section, illustrating the butterfly configuration of the base member.
Figure 5:
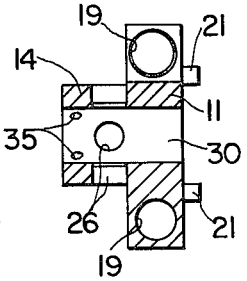
FIG. 5 is a sectional view taken along the line 5—5 of FIG. 4 and illustrates additional details of the base member.
Figure 6:
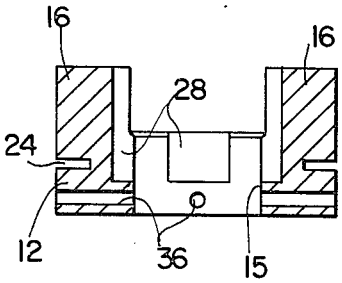
FIG. 6 is a sectional view of the rotor illustrating various details of its construction.
Figure 7:
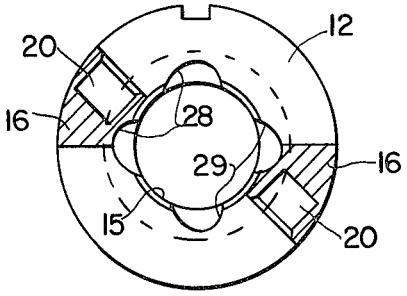
FIG. 7 is a plan view, partially in section, of the rotor shown in FIG. 6 and illustrates the hemispherical recesses which receive the locking balls when the mechanism is unlocked.

Attention now is directed to the drawings, wherein like numerals of reference designate like parts throughout the several views, and more particularly to FIGS. 1 to 3 wherein there is illustrated the rotary locking mechanism of the present invention designated generally by the reference numeral 10. The mechanism 10 comprises a base member 11, of substantially butterfly configuration, and a rotor 12. The base member 11 is provided with an axially extending hollow projection 14 which is received within a central aperture 15 formed in the rotor 12. The cylindrical projection 14 may be best seen in FIGS. 4 and 5. The rotor 12 is provided with a pair of axially extending projections 16 which project into the spaces between the wings of the butterfly configured base 11. The projections 16 may be seen in more detail in FIGS. 6 and 7.

A pair of compression springs 18 are fitted into blind apertures 19, in the base 11, and blind apertures 20, in the projections 16, and normally urge rotation of the base of the rotor 12, relative to the base 11, to the unlocked position shown in FIG. 1. A pair of dowel pins 21 are fixed in the base 11 and serve to orient the mechanism 10 when it is mounted in a weapon (not shown). A retaining ring 22, mounted in a groove 24 formed in the rotor 12, is provided for engagement with a groove in the recess provided in the weapon for the mechanism 10 to hold the mechanism in place.

A plurality of hardened metal balls 25, is disposed within apertures 26 formed in the projection 14 of the base 11. The interior of the rotor 12 is provided with a plurality of substantially hemispherical recesses 28 (FIG. 7) which accommodate the balls 25 when the mechanism is unlocked. The recesses 28 are provided with tangent surfaces 29 to facilitate movement of the balls into and out of the recesses 28.

OPERATION

In order that a better understanding of the invention might be had, its mode of operation will now be described.

Figure 8:
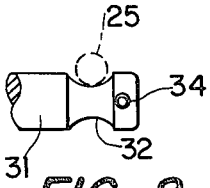
FIG. 8 is a fragmentary view of the arming shaft which is locked by the mechanism and illustrating the circumferential groove engaged by the locking balls.

An arming shaft 31 (FIG. 8) is introduced into a central aperture 30 formed in the projection 14 until a circumferential groove 32 in the shaft lies in the plane of the balls 25. The tip of the shaft 31 will then be flush with the top surface of the rotor 12 as viewed in FIG. 3. The rotor 12 is then rotated relative to the base 11, clockwise in FIG. 1 and counter-clockwise in FIG. 3, to compress the springs 18. This rotation causes the balls 25 to roll out of the recesses 28 along the tangent surfaces 29 until they engage the inside diameter of the aperture 15. The radially inward movement of the balls 25 forces them partially through the apertures 26 into the central aperture 30 and into engagement with the circumferential groove 32 in the shaft 31 as shown in FIG. 8. In this position, the balls 25 preclude any axial movement of the arming shaft 31. When the springs have been substantially fully compressed, arming holes 34, 35 and 36, in the shaft 31, projection 14 and rotor 12, respectively, will all be axially aligned and an arming wire or lanyard 38, shown in FIG. 3, may be inserted into these aligned holes to lock the mechanism and shaft in the safe positions. The mechanism is now locked with the arming shaft in the safe position until removal of the arming wire.

From the foregoing it will be readily apparent that the present invention possesses numerous advantages not found in prior art devices. For example, the rotary locking and unlocking motion is controllable by arming wires, or lanyards, as well as flat surfaces or channel-shaped devices engaging the flat sides of the rotor 12, which are best seen in FIG. 3. Also, rotary motion instead of longitudinal motion to provide the locking action saves space and prevents unwanted protrusions as well as affording compactness, high strength, durability and low parts count. Further, the mechanism of the present invention enables visual inspection of the shaft and lock conditions since the rotor 12 and tip of the shaft 31 can be flush with the surface of the weapon in which it is mounted. Additionally, redundant locking is provided since the shaft 31 is locked in a safe position, not only by the rotary locking mechanism, but also by the arming wire.

Obviously many modifications and variations of the present invention are possible in the light of the above teachings and would readily occur to those skilled in the art. For example, the invention could include means to restrain the arming shaft from rotary motion as well as longitudinal motion by using hemispherical holes or even counter-bores in the shaft so that the balls grip the shaft in all directions when locked. Also, soluble elements could be used to hold the rotary mechanism locked until dissolved under water for under water weapons. Further, a solenoid or explosive actuator could also easily be utilized to release the rotary lock either from within the weapon or from the launch vehicle, and since aircraft often require the capability to jettison in a safe condition the pilot could be provided with means to operate a solenoid to permanently lock the rotary lock. Additionally, the shaft being locked could be of any appropriate size and shape and could be altered to release inwardly or outwardly. Thus the present invention could be utilized as a release mechanism in separating a cable from its mounting or to fulfill any similar need to mechanically release one part from another with a simple rotary motion. It is therefore to be understood that within the scope of the appended claims the invention may be practiced otherwise than as specifically described.

I claim:

1. A rotary-acting, safing and arming, ball-lock mechanism for releasably locking an arming shaft of a weapon against axial movement, said arming shaft having an engageable surface, comprising:

a base member having a central longitudinal aperture therein for receiving the arming shaft;

a rotor mounted for limited rotary movement on said base member;

a plurality of radial apertures formed in said base member and communicating with said central longitudinal aperture;

a plurality of balls disposed in said radial apertures;

a plurality of cam surfaces formed on said rotor for moving said balls partially through said radial apertures into said central aperture and into engagement with the arming shaft engageable surface to lock the shaft against movement when said rotor is moved to a safe position;

means for locking said base member and said rotor in the safe position; and a pair of compression springs interposed between said base member and said rotor for moving said rotor to an arming position when said locking means is released whereby said balls are free to disengage the arming shaft engageable surface, release the arming shaft and permit axial movement of the arming shaft to the arming position to arm the weapon.

2. A mechanism as defined in claim 1 wherein said base member is provided with a pair of dowel pins on the side opposite said rotor for positioning said mechanism when inserted into a weapon.

3. A mechanism as defined in claim 1 wherein said rotor is provided with a circumferential slot to accommodate a retaining ring for holding said mechanism within a recess in a weapon.

4. A mechanism as defined in claim 1 wherein said locking means comprises a plurality of arming wire holes formed in said base member and said rotor, said holes being axially aligned when said rotor is in the safe position; and an arming wire for insertion into the aligned holes for locking said rotor in the safe position.

5. A mechanism as defined in claim 4 wherein said base member is provided with a pair of dowel pins on the side opposite said rotor for positioning said mechanism when inserted into a weapon; and said rotor is provided with a circumferential slot to accommodate a retaining ring for holding said mechanism within a recess in the weapon.

6. A rotary-acting, safing and arming, ball-lock mechanism for releasably locking a circumferentially-grooved arming shaft of a weapon against axial movement comprising:

a base member of substantially butterfly configuration having wing members and having a cylindrical projection extending axially therefrom, said cylindrical projection being provided with a central longitudinal aperture therein for receiving the arming shaft;

a rotor mounted on said cylindrical projection by means of a central aperture in said rotor for rotary movement relative to said base member, said rotor being provided with a pair of axial projections which extend between the wing members of the butterfly configuration whereby rotary movement of the rotor is limited;

a plurality of radial apertures formed in said cylindrical projection and communicating with said central longitudinal aperture;

a plurality of substantially hemispherical recesses formed in the interior surface of the central aperture in said rotor and in the plane of said radial apertures;

a plurality of balls disposed partially in said hemispherical recesses and partially in said radial apertures;

a plurality of cam surfaces tangent to said hemispherical recesses for moving said balls out of said hemispherical recesses and partially through said radial apertures into said central aperture and into engagement with the circumferential groove of the arming shaft to lock the shaft against axial movement when said rotor is moved to a safe position;

a pair of arming wire holes formed in both said cylindrical projection and said rotor, said arming wire holes being axially aligned when said rotor is in the safe position;

an arming wire positioned in said arming wire holes for locking said rotor in the safe position; and a pair of compression springs interposed between the wing members of said butterfly configuration and the axial projections on said rotor for moving said rotor to an arming position when said arming wire is removed whereby said balls are free to move back into said hemispherical recesses through said radial apertures to release the arming shaft and permit axial movement thereof to the arming position to arm the weapon.

* * * * *